US011833564B2

(12) United States Patent
Ishihara et al.

(10) Patent No.: US 11,833,564 B2
(45) Date of Patent: Dec. 5, 2023

(54) FORMING APPARATUS AND FORMING METHOD USING FORMING APPARATUS

(71) Applicant: HONDA MOTOR CO., LTD., Tokyo (JP)

(72) Inventors: Yoshimitsu Ishihara, Tokyo (JP); Kenichi Chida, Tokyo (JP); Hiroki Sato, Tokyo (JP); Mitsufumi Okada, Tokyo (JP); Naoharu Wakida, Tokyo (JP); Yuta Rokugawa, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/887,469

(22) Filed: Aug. 14, 2022

(65) Prior Publication Data

US 2023/0060061 A1 Feb. 23, 2023

(30) Foreign Application Priority Data

Aug. 20, 2021 (JP) ..... 2021-135134

(51) Int. Cl.
*B21D 24/04* (2006.01)
*B21D 53/88* (2006.01)

(52) U.S. Cl.
CPC ..... *B21D 24/04* (2013.01); *B21D 53/88* (2013.01)

(58) Field of Classification Search
CPC ..... B21D 22/02; B21D 22/20; B21D 22/22; B21D 22/26; B21D 24/04
See application file for complete search history.

(56) References Cited

U.S. PATENT DOCUMENTS

2009/0301163 A1* 12/2009 Hallfeldt ..... B21D 22/22 72/347
2010/0201031 A1* 8/2010 Kubo ..... B21D 22/02 425/112

FOREIGN PATENT DOCUMENTS

JP S56-117831 A 9/1981

* cited by examiner

*Primary Examiner* — Debra M Sullivan
(74) *Attorney, Agent, or Firm* — Carrier, Shende & Associates P.C.; Fulchand P. Shende; Joseph P. Carrier

(57) ABSTRACT

An upper die of a forming apparatus includes a first curved portion and a second curved portion between a second concave section and an upper holding surface. The first curved portion is curved in a direction away from the upper die. The second curved portion is curved toward the upper die. A blank holding surface of a blank holder holds a blank between the blank holding surface and the upper holding surface of the upper die. The blank holding surface faces the second curved portion. The blank holding surface includes a blank curved surface recessed along the second curved portion.

6 Claims, 7 Drawing Sheets

FORMING APPARATUS AND FORMING METHOD USING FORMING APPARATUS

CROSS-REFERENCE TO RELATED APPLICATIONS

This application is based upon and claims the benefit of priority from Japanese Patent Application No. 2021-135134 filed on Aug. 20, 2021, the contents of which are incorporated herein by reference.

BACKGROUND OF THE INVENTION

Field of the Invention

The present invention relates to a forming apparatus for press-forming a blank, and a forming method using the forming apparatus.

Description of the Related Art

Conventionally, main frame parts of an automobile are produced by press-forming a metal plate. For example, a side panel, which is one of the main frame parts, includes an opening for a side door. The lower end of the side panel is disposed below the opening and constitutes the lower portion of the automobile. Rigidity is required for the lower end of the side panel. Therefore, the lower end of the side panel is formed by deep drawing.

It is known that, in the deep drawing, springback is likely to occur in a formed body obtained by the forming. The springback can be reduced by, for example, applying tension to a deformation portion of the metal plate that is bent and deformed, until plastic deformation occurs therein. In this case, it is necessary to adjust the tension applied to the metal plate. For example, the pressing force to the metal plate is increased by a blank holder. Alternatively, the metal plate is provided with a draw bead.

In recent years, high-tensile steel plates are often used for main frame parts of automobiles. The high-tensile steel plate has a characteristic that the ductility decreases as the strength increases. Therefore, when the main frame part, such as the side panel, is manufactured by deep-drawing a high-tensile steel plate, there is a concern that breakage may occur if the tension applied to the steel plate is increased.

Therefore, in general, when a high-tensile steel plate is deep-drawn, restriking is performed in which a primary formed product obtained by forming is subjected to secondary forming in the next step. In the restriking step, the workpiece is pressed in the direction opposite to the direction of warpage generated in the primary formed product, and the warpage in the primary formed product is oriented in the opposite direction. As a result, in the restriking step, the warp generated in the primary formed product is corrected to obtain a secondary formed product.

For example, in a forming apparatus disclosed in JP S56-117831 A, a material is bent and deformed by a punch and a die. The gap between the punch and the die is controlled to be 1.0 to 1.4 times the thickness of the material. When a bent portion is formed in the material between the punch and the die, a reverse bending in a direction opposite to the bending direction of the bent portion occurs in the gap. The reverse bending suppresses the warpage generated when the material is formed.

SUMMARY OF THE INVENTION

In the forming apparatus disclosed in JP S56-117831 A, it is not necessary to perform restriking on a formed product obtained by forming the material. Therefore, the equipment cost required for the forming apparatus can be suppressed. Further, by eliminating the need for restriking, it is possible to shorten the manufacturing time. However, in the forming apparatus, it is necessary to appropriately control the gap between the punch and the die according to the thickness or the quality of the material to be formed. Therefore, control of the gap in accordance with the plate thickness or the like is complicated. In addition, the accuracy of the formed product varies depending on the control condition of the gap.

According to an aspect of the present invention, provided is a forming apparatus that obtains a workpiece including a vertical portion extending along a die closing direction by drawing a blank, the forming apparatus comprising: a lower die including a convex-shaped forming portion that includes a first vertical surface; an upper die that faces the lower die and is movable relative thereto, the upper die including a concave-shaped forming portion into which the convex-shaped forming portion is inserted, and an upper holding portion adjacent to the concave-shaped forming portion, wherein the concave-shaped forming portion includes a second vertical surface, and the vertical portion is formed between the first vertical surface and the second vertical surface; and a blank holder that faces the upper holding portion of the upper die, and is configured to press the blank toward the upper holding portion, wherein the upper die includes, between the concave-shaped forming portion and the upper holding portion: a first curved portion that is curved so as to bulge in a direction away from the upper die, and is configured to form a first bent portion in the blank; and a second curved portion that is curved in a direction opposite to a bulging direction of the first curved portion, and is configured to form a second bent portion in the blank, the first curved portion is disposed between the concave-shaped forming portion and the second curved portion, and the blank holder includes a blank holding portion that faces the upper holding portion and is configured to hold the blank, the blank holding portion including a blank curved portion facing the second curved portion and curved along the second curved portion.

According to another aspect of the present invention, provided is a forming method for obtaining a workpiece including a vertical portion extending along a die closing direction by drawing a blank using a forming apparatus, wherein the forming apparatus includes: a lower die including a convex-shaped forming portion that includes a first vertical surface; an upper die that faces the lower die and is movable relative thereto, the upper die including a concave-shaped forming portion into which the convex-shaped forming portion is inserted, and an upper holding portion adjacent to the concave-shaped forming portion, wherein the concave-shaped forming portion includes a second vertical surface, and the vertical portion is formed between the first vertical surface and the second vertical surface; and a blank holder that faces the upper holding portion of the upper die, and is configured to press the blank toward the upper holding portion, the upper die includes, between the concave-shaped forming portion and the upper holding portion: a first curved portion that is curved so as to bulge in a direction away from the upper die and is configured to form a first bent portion in the blank; and a second curved portion that is curved in a direction opposite to a bulging direction of the first curved portion and is configured to form a second bent portion in the blank, the first curved portion is disposed between the concave-shaped forming portion and the second curved portion, and the blank holder includes a blank holding portion that faces the upper holding portion and is configured to hold the blank, the blank holding portion including a blank curved portion facing the second curved portion and curved along the second curved portion, the forming method comprising: holding the blank between the upper holding portion and the blank holding portion; and drawing the blank by moving the upper die and the lower die relative to each other, wherein in the drawing of the blank, when a region of the blank that is finally formed into the vertical portion is defined as a vertical portion-intended region, the vertical portion-intended region moves from between the upper holding portion and the blank holding portion to between the first vertical surface and the second vertical surface, and the drawing of the blank includes: bending the vertical portion-intended region by the second curved portion; bending, by the first curved portion, the vertical portion-intended region that has been formed by the second curved portion; and forming the vertical portion-intended region that has been moved to between the first vertical surface of the lower die and the second vertical surface of the upper die, into a flat shape by the first vertical surface and the second vertical surface.

According to the present invention, the following effects can be obtained.

Specifically, the upper die includes the first curved portion and the second curved portion between the concave-shaped forming portion and the upper holding portion. The first curved portion is curved so as to bulge in a direction away from the upper die. The first curved portion is configured to form the first bent portion in the blank. The second curved portion is curved in a direction opposite to the bulging direction of the first curved portion. The second curved portion is configured to form the second bent portion in the blank.

In the process of forming a workpiece including a vertical portion extending along the die-closing direction of the upper die and the lower die, a region (vertical portion-intended region) of the blank that is finally formed into the vertical portion passes through the second curved portion and the first curved portion in this order, and reaches between the first vertical surface of the lower die and the second vertical surface of the upper die. That is, before being subjected to bending deformation by the first curved portion, the vertical portion-intended region is subjected to bending deformation by the second curved portion in the direction opposite to the direction of the bending deformation applied by the first curved portion. Therefore, when the vertical portion-intended region reaches between the first vertical surface and the second vertical surface and the vertical portion is formed, the residual stress in the vertical portion is reduced. Accordingly, when a workpiece having a vertical portion is formed, generation of residual stress in the vertical portion can be suppressed with a simple configuration. As a result, it is possible to suitably suppress warpage of the vertical portion of the workpiece.

The above and other objects, features, and advantages of the present invention will become more apparent from the following description when taken in conjunction with the accompanying drawings, in which a preferred embodiment of the present invention is shown by way of illustrative example.

DESCRIPTION OF THE INVENTION

A forming apparatus 10 is used for obtaining a workpiece W by drawing a blank 12. In the present embodiment, the workpiece W is a side outer panel for an automobile. The blank 12 is, for example, a high-tensile steel plate.

Figure 1:
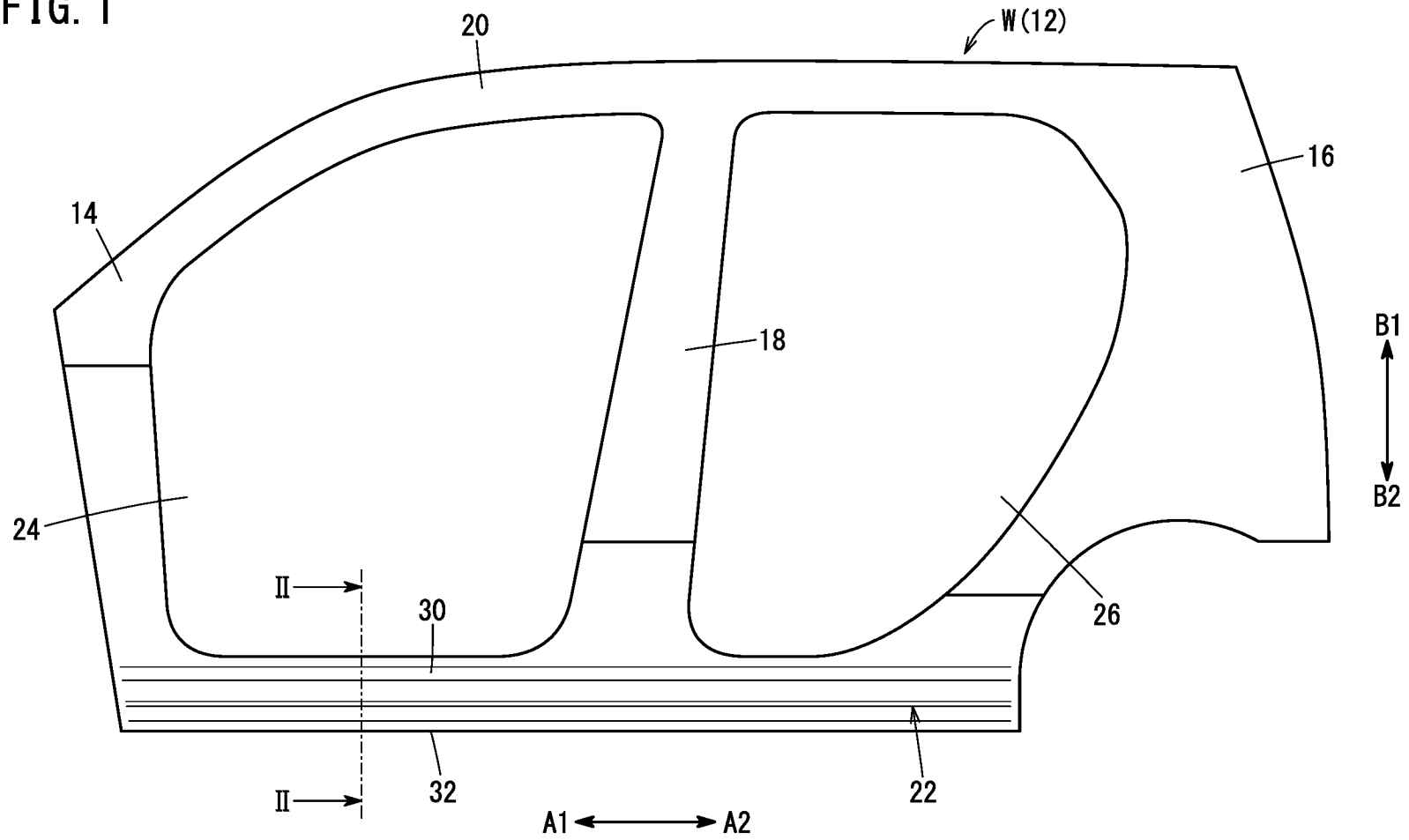
FIG. 1 is an overall front view of a workpiece formed by a forming apparatus according to an embodiment of the present invention.

The side outer panel, which is the workpiece W, is a formed product obtained by the forming apparatus 10. The workpiece W constitutes a side portion of a body of an automobile. As shown in FIG. 1, the workpiece W includes a front pillar 14, a rear pillar 16, a center pillar 18, a roof portion 20, and a side sill 22.

The side sill 22 extends substantially horizontally from the lower end of the front pillar 14 to the lower end of the rear pillar 16. The side sill 22 is connected to the lower end of the front pillar 14, the lower end of the center pillar 18, and the lower end of the rear pillar 16.

The workpiece W includes a first opening 24. The first opening 24 is surrounded by the front pillar 14, the center pillar 18, the roof portion 20, and the side sill 22. A front door (not shown) can be attached to the first opening 24. The workpiece W includes a second opening 26. The second opening 26 is surrounded by the center pillar 18, the rear pillar 16, the roof portion 20, and the side sill 22. A rear door (not shown) can be attached to the second opening 26.

Figure 2:
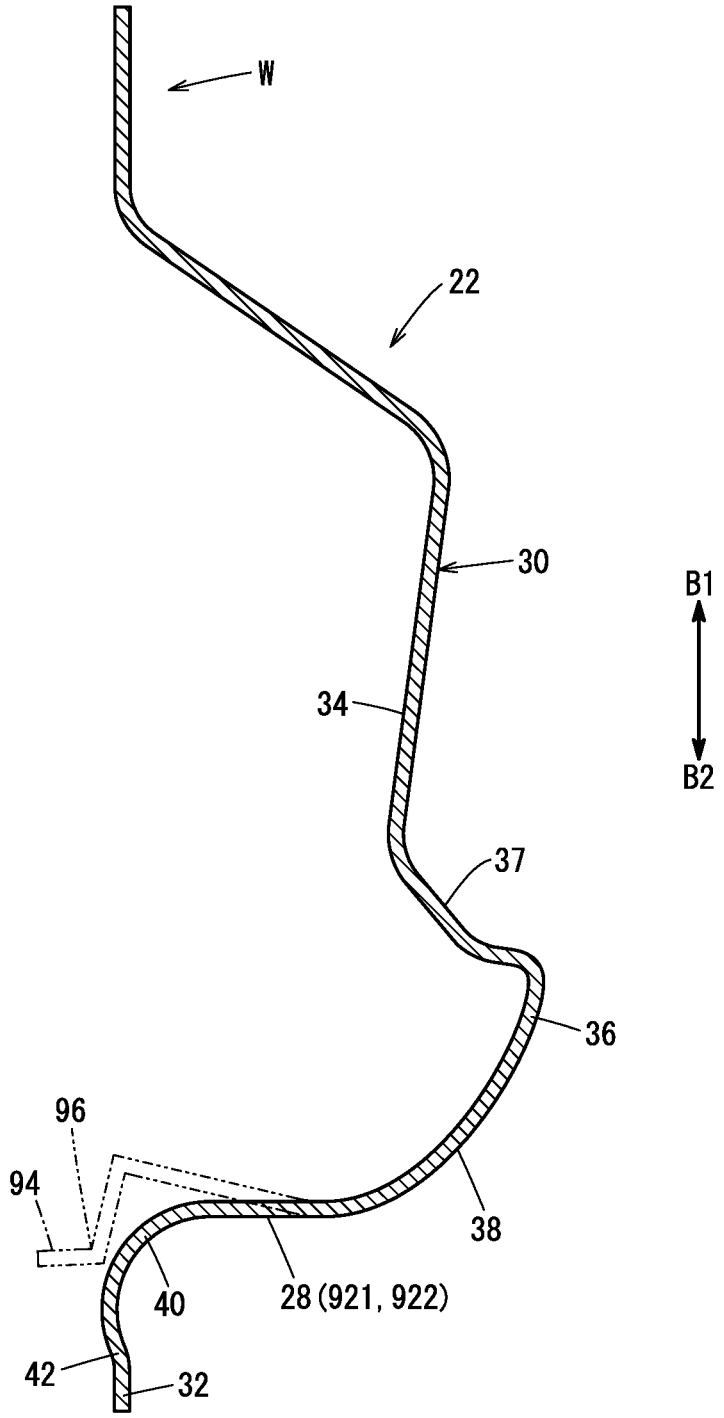
FIG. 2 is a cross-sectional view taken along line II-II of FIG. 1.

The side sill 22 extends in a straight line along the front-rear direction of the automobile (directions of arrows A1 and A2). As shown in FIGS. 1 and 2, the side sill 22 includes an under portion (vertical portion) 28, a side portion 30, and a flange portion 32. The under portion 28 is disposed at a lower portion of the side sill 22. The under portion 28 is flat and extends in the horizontal direction. The under portion 28 faces the ground in the automobile in which the workpiece W is used. That is, the under portion 28 is disposed substantially parallel to the ground (not shown).

The side portion 30 is disposed at a side portion in the vehicle width direction of the automobile in which the workpiece W is used. The side portion 30 is disposed at a widthwise outer end of the under portion 28, which is an outer end portion in the vehicle width direction. The side portion 30 includes a base part 34 and a projecting part 36.

The base part 34 is disposed at an upper portion of the side portion 30. The base part 34 extends in a straight line along a substantially vertical direction. The base part 34 is substantially orthogonal to the under portion 28. The upper end of the base part 34 faces the first opening 24 and the second opening 26, and is connected to the lower end of the center pillar 18.

The projecting part 36 is disposed further outward in the vehicle width direction than the base part 34. The projecting part 36 is disposed below the base part 34 (in a direction of arrow B2). The upper end of the projecting part 36 protrudes most outward in the vehicle width direction. The projecting part 36 is inclined inward in the vehicle width direction from the upper end toward the lower end of the projecting part 36. The upper end of the projecting part 36 and the lower end of the base part 34 are connected by an inclined part 37. The inclined part 37 is inclined relative to the extending direction of the base part 34.

The projecting part 36 is slightly curved outward in the vehicle width direction. The lower end of the projecting part 36 is connected to the widthwise outer end of the under portion 28, which is the outer end portion in the vehicle width direction. A connection angle between the projecting part 36 and the under portion 28 is an obtuse angle. An arc portion 38 is disposed between the projecting part 36 and the widthwise outer end of the under portion 28. The cross-sectional shape of the arc portion 38 is an arc shape curved radially outward. The projecting part 36 and the widthwise outer end of the under portion 28 are connected by the arc portion 38.

The flange portion 32 is disposed at a widthwise inner end of the under portion 28, which is an inner end portion in the vehicle width direction, the widthwise inner end being on the side opposite to the side portion 30 in the vehicle width direction. The flange portion 32 is substantially orthogonal to the under portion 28. The flange portion 32 protrudes downward (in the direction of arrow B2) from the under portion 28 in the automobile. An under floor (not shown) configuring a bottom surface of the automobile is connected to the widthwise inner side of the flange portion 32 by welding or the like.

A first bent portion 40 is disposed between the flange portion 32 and the under portion 28. The cross-sectional shape of the first bent portion 40 is an arc shape curved in a direction away from the under portion 28 (inward in the width direction). A part of the first bent portion 40 is disposed further inward in the width direction than the flange portion 32.

A second bent portion 42 is provided between the first bent portion 40 and the upper end of the flange portion 32. The cross-sectional shape of the second bent portion 42 is an arc shape curved toward the under portion 28. The second bent portion 42 connects the upper end of the flange portion 32 and the lower end of the first bent portion 40. In the width direction of the side sill 22, the second bent portion 42 is disposed between the flange portion 32 and a part of the first bent portion 40 that is located most inward in the width direction. The radius of curvature of the second bent portion 42 is smaller than the radius of curvature of the first bent portion 40.

Next, the forming apparatus 10 for forming the above-described workpiece W will be described.

As shown in FIGS. 3 to 7, the forming apparatus 10 includes a lower die 44, an upper die 46, and a blank holder 48. In the forming apparatus 10, the above-described workpiece W (the blank 12) is placed along the width direction (directions of arrows D1 and D2), which is the horizontal direction, and the workpiece W is formed. That is, in the forming apparatus 10, the up-down direction of the workpiece W is the horizontal direction (width direction) when forming is performed by the forming apparatus 10.

The lower die 44 is a fixed die fixed to a base (not shown) or the like. The lower die 44 includes a lower forming portion 50. The lower forming portion 50 is disposed at a widthwise outer edge of the lower die 44. The lower forming portion 50 can form the side sill 22 of the workpiece W. The lower forming portion 50 includes a first convex section (a convex-shaped forming portion) 52 and a first concave section 54.

The first convex section 52 is disposed at a widthwise outer edge of the lower forming portion 50. The first convex section 52 includes a first vertical surface 56, a protrusion 58, and a curved surface 60. The first vertical surface 56 is disposed at a widthwise outer edge of the first convex section 52. The first vertical surface 56 extends along a die-opening direction (directions of arrows E1 and E2) of the upper die 46 and the lower die 44 orthogonal to the width direction (the directions of arrows D1 and D2). The first vertical surface 56 is flat along the die-opening direction (the directions of arrows E1 and E2). When the workpiece W is formed by the upper die 46 and the lower die 44, the first vertical surface 56 can form the under portion 28 of the side sill 22.

The protrusion 58 protrudes from the first vertical surface 56 toward the upper die 46. The protrusion 58 gradually protrudes inward in the width direction (a direction of arrow D1) as the distance from the first vertical surface 56 increases. The protrusion 58 includes the curved surface 60. The cross-sectional shape of the protrusion 58 including the curved surface 60 is an arc shape curved toward the upper die 46. The cross-sectional shape of the protrusion 58 corresponds to the cross-sectional shape of the projecting part 36 of the side sill 22. The curved surface 60 of the protrusion 58 is connected to the upper end of the first vertical surface 56. A widthwise inner end of the protrusion 58, which is an inner end portion in the width direction, is connected to the first concave section 54.

The first concave section 54 is disposed further inward in the width direction (in the direction of arrow D1) than the first convex section 52. The first concave section 54 is recessed further downward (in a direction of arrow E2) than the protrusion 58 of the first convex section 52. The cross-sectional shape of the first concave section 54 corresponds to the cross-sectional shapes of the base part 34 and the inclined part 37 of the side sill 22. A widthwise outer end of the first concave section 54, which is on the outer side in the width direction, is connected to the protrusion 58 of the first convex section 52.

A widthwise inner end of the first concave section 54 constitutes the first opening 24 on the front side of the center of the workpiece W in the front-rear direction (the directions of arrows A1 and A2) shown in FIG. 1. The widthwise inner end of the first concave section 54 is connected to the front pillar 14. The widthwise inner end of the first concave section 54 constitutes the second opening 26 on the rear side of the center of the workpiece W in the front-rear direction. The widthwise inner end of the first concave section 54 is connected to the rear pillar 16. The widthwise inner end of the first concave section 54 is connected to the center pillar 18 at the center of the workpiece W in the front-rear direction.

The upper die 46 is a movable die fixed to a raising/lowering device (not shown). The upper die 46 is disposed above the lower die 44 (in the direction of arrow E1). The upper die 46 can approach or separate from the lower die 44 by being driven by the raising/lowering device. The upper die 46 includes an upper forming portion 62. The upper forming portion 62 is disposed at a widthwise outer edge of the upper die 46 that is on the outer side in the width direction. The upper forming portion 62 can form the side sill 22 of the workpiece W. The upper forming portion 62 includes a first forming section 64 and a second forming section 66.

The first forming section 64 faces the lower forming portion 50 of the lower die 44. When the upper die 46 and the lower die 44 approach each other and die-closing is performed, the first forming section 64 and the lower forming portion 50 are engaged with each other. The first forming section 64 includes a second concave section (concave-shaped forming portion) 68 and a second convex section 70.

The second concave section 68 is disposed at a widthwise outer end of the first forming section 64, which is an outer end portion in the width direction. The second concave section 68 is recessed in a direction away from the lower die 44 (the direction of arrow E1). The cross-sectional shape of the second concave section 68 is the same as the cross-sectional shape of the first convex section 52. The cross-sectional shape of the second concave section 68 corresponds to the cross-sectional shapes of the projecting part 36 and the inclined part 37 of the side sill 22.

In the width direction of the first forming section 64, the second convex section 70 is disposed further inward in the width direction (in the direction of arrow D1) than the second concave section 68. The second convex section 70 protrudes further toward the lower die 44 than the second concave section 68. The cross-sectional shape of the second convex section 70 is the same as the cross-sectional shape of the first concave section 54. The second convex section 70 can be inserted into the first concave section 54 of the lower die 44. The cross-sectional shape of the second convex section 70 corresponds to the cross-sectional shapes of the base part 34 and the inclined part 37 of the side sill 22.

The second forming section 66 is disposed further outward in the width direction (in the direction of arrow D2) than the first forming section 64. The second forming section 66 faces the blank holder 48. The second forming section 66 protrudes further downward (in the direction of arrow E2) than the first forming section 64. The second forming section 66 includes an upper holding surface (upper holding portion) 72, a protruding portion 74, a second vertical surface 76, a first curved portion 78, and a second curved portion 80.

The upper holding surface 72 extends in the width direction (the directions of arrows D1 and D2) orthogonal to the die opening direction (the directions of arrows E1 and E2) of the upper die 46 and the lower die 44. The upper holding surface 72 is flat. The upper holding surface 72 faces a blank holding surface 82 of the blank holder 48. The upper holding surface 72 is parallel to the blank holding surface 82 of the blank holder 48.

The protruding portion 74 protrudes from the upper holding surface 72 toward the blank holder 48. The cross-sectional shape of the protruding portion 74 is a semicircle bulging toward the blank holder 48. The protruding portion 74 is separated, by a predetermined distance, from the lower die 44 outward in the width direction (in the direction of arrow D2) on the upper holding surface 72. The protruding portion 74 faces a groove portion 84 of the blank holder 48, which will be described later, in the die opening direction (the directions of arrows E1 and E2) of the forming apparatus 10. The protruding portion 74 can form a bead 81 on the workpiece W (the blank 12).

The second vertical surface 76 is disposed at a widthwise inner end of the second forming section 66, which is an inner end portion in the width direction. The second vertical surface 76 extends along the die opening direction (the directions of arrows E1 and E2) of the upper die 46 and the lower die 44 orthogonal to the width direction of the forming apparatus 10. The second vertical surface 76 is flat along the die opening direction. The second vertical surface 76 faces the first vertical surface 56 of the lower die 44. The second vertical surface 76 and the first vertical surface 56 are parallel to each other. When the upper die 46 and the lower die 44 are brought close to each other to perform die closing, the under portion 28 of the workpiece W can be formed between the second vertical surface 76 and the first vertical surface 56.

Figure 5:
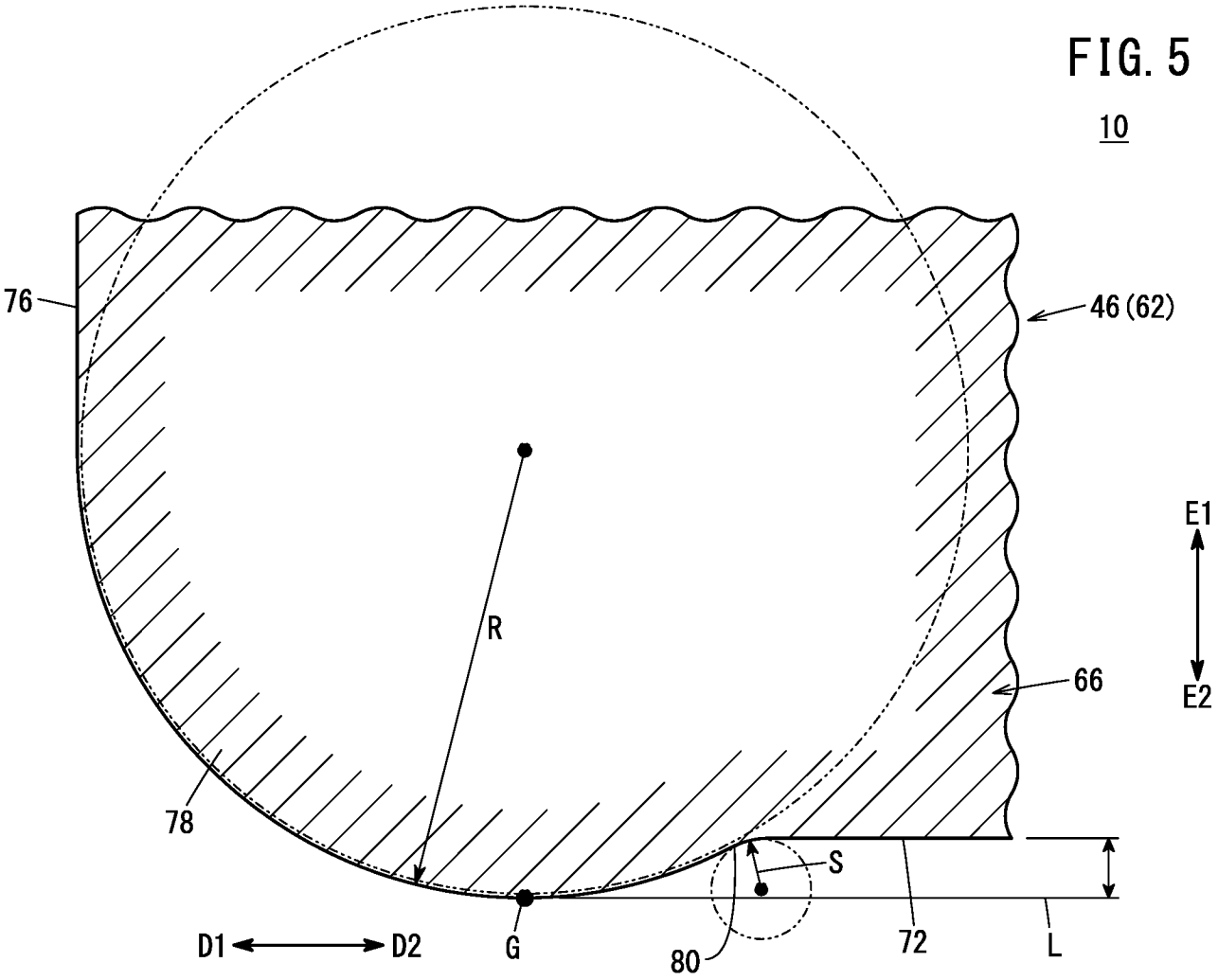
FIG. 5 is an enlarged cross-sectional view of a main part of an upper die.

The upper end of the second vertical surface 76 is connected to the second concave section 68 of the first forming section 64. The first curved portion 78 is connected to the lower end of the second vertical surface 76. The first curved portion 78 is disposed between the second vertical surface 76 and the upper holding surface 72. The cross-sectional shape of the first curved portion 78 is an arc shape curved in a direction away from the upper die 46. As shown in FIG. 5, a radius of curvature R of the first curved portion 78 is greater than a radius of curvature S of the second curved portion 80 described later (R>S).

As shown in FIG. 5, the first curved portion 78 is in contact with an imaginary line L that is offset downward (in the direction of arrow E2) from the upper holding surface 72. The imaginary line L and the upper holding surface 72 are parallel to each other. The upper die 46 has a contact point G where the first curved portion 78 and the imaginary line L are in contact with each other. The first curved portion 78 extends beyond the contact point G to the upper holding surface 72. The first curved portion 78 protrudes downward (in the direction of arrow E2) from the upper holding surface 72 by a predetermined distance.

The second curved portion 80 is disposed between the first curved portion 78 and the upper holding surface 72. The cross-sectional shape of the second curved portion 80 is an arc shape curved toward the upper die 46. The radius of curvature S of the second curved portion 80 is smaller than the radius of curvature R of the first curved portion 78 (S<R). The second curved portion 80 is curved toward the upper die 46. The first curved portion 78 and the upper holding surface 72 are connected via the second curved portion 80. The curving direction (bending direction) of the first curved portion 78 and the curving direction (bending direction) of the second curved portion 80 are opposite directions.

As shown in FIGS. 3, 4, 6, and 7, the blank holder 48 is arranged further outward in the width direction (in the direction of arrow D2) than the widthwise outer edge of the lower die 44, which is on the outer side in the width direction. The blank holder 48 faces the second forming section 66 of the upper die 46. The blank holder 48 is disposed at the lower die 44. The blank holder 48 can be raised and lowered independently with respect to the lower die 44 by a pin mechanism (not shown). The blank holder 48 can approach the upper die 46 by the operation of the pin mechanism. The blank holder 48 is biased toward the upper holding surface 72 by the pin mechanism (not shown) to press the blank 12.

The blank holder 48 includes the blank holding surface (blank holding portion) 82, the groove portion 84, and a blank curved surface (blank curved portion) 86. The blank holding surface 82 extends in the width direction (the directions of arrows D1 and D2) orthogonal to the die opening direction of the upper die 46 and the lower die 44. The blank holding surface 82 is flat and extends horizontally. The blank holding surface 82 faces the upper holding surface 72 of the upper die 46. The blank holding surface 82 is parallel to the upper holding surface 72. When the upper die 46 and the lower die 44 are brought close to each other to perform die closing, the blank 12 is held between the blank holding surface 82 and the upper holding surface 72.

The groove portion 84 is disposed in the blank holding surface 82. The groove portion 84 is recessed downward (in the direction of arrow E2) so as to be separated from the upper die 46. The groove portion 84 faces the protruding portion 74 of the upper die 46 in the die opening direction (the directions of arrows E1 and E2) of the upper die 46 and the lower die 44. The cross-sectional shape of the groove portion 84 is a semicircular shape similar to that of the protruding portion 74. When the upper die 46 and the lower die 44 are brought close to each other to perform die-closing, the protruding portion 74 is inserted into the groove portion 84 together with the blank 12. The bead 81 is formed by the groove portion 84 and the protruding portion 74.

The blank curved surface 86 is disposed more inward in the width direction (in the direction of the arrow D1) than the groove portion 84. The blank curved surface 86 is connected to the blank holding surface 82. The blank curved surface 86 includes a horizontal surface 88 and a blank curved portion 90.

The horizontal surface 88 is disposed at a widthwise inner end of the blank curved surface 86, which is an inner end portion in the width direction. The horizontal surface 88 is adjacent to the first vertical surface 56 of the lower die 44. The horizontal surface 88 extends in the width direction (the directions of arrows D1 and D2) orthogonal to the die opening direction of the upper die 46 and the lower die 44. The horizontal surface 88 is flat and offset downward (in the direction of arrow E2) from the blank holding surface 82. When the upper die 46 and the lower die 44 are brought close to each other to perform die closing, the horizontal surface 88 and the first curved portion 78 face each other.

The blank curved portion 90 is disposed between the horizontal surface 88 and the blank holding surface 82. The cross-sectional shape of the blank curved portion 90 is an arc shape curved and bulging in a direction toward the upper die 46. In the die opening direction of the upper die 46 and the lower die 44, the blank curved portion 90 faces the second curved portion 80 of the upper die 46. A radius of curvature of the blank curved portion 90 corresponds to the radius of curvature S of the second curved portion 80. When the upper die 46 and the lower die 44 are brought close to each other to perform die closing, the second bent portion 42 of the workpiece W can be formed between the blank curved portion 90 and the second curved portion 80.

Next, with reference to FIGS. 3, 4, 6, and 7, a description will be given of a case where the workpiece W is drawn by performing a drawing step of the blank 12 using the forming apparatus 10. The blank 12 is a flat high-tensile steel plate having a constant thickness. In the blank 12 shown in FIGS. 6 and 7, a region (a vertical portion-intended region) that is finally formed into the under portion 28 is denoted by P.

Figure 6:
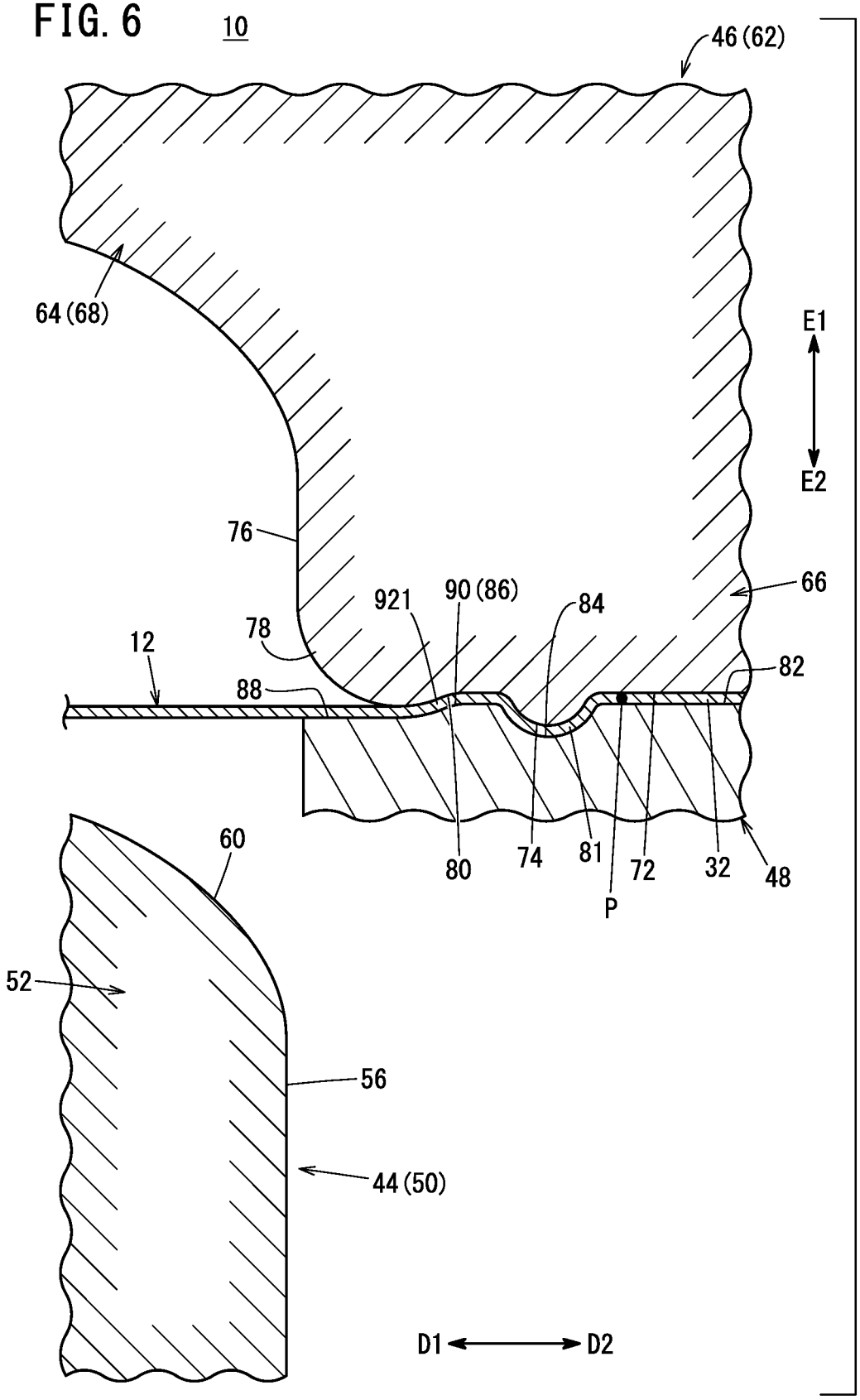
FIG. 6 is a cross-sectional view showing a stage in the course of forming in which a blank is held by the upper die and a blank holder of the forming apparatus.

First, the upper die 46 and the lower die 44 are separated from each other in the up-down direction (the directions of arrows E1 and E2) to perform die opening. In the die opening of the forming apparatus 10, the upper die 46 is disposed above the lower die 44 and the blank holder 48 (in the direction of arrow E1) so as to be separated therefrom. The blank holding surface 82 of the blank holder 48 and the upper holding surface 72 of the upper die 46 are vertically separated from each other. As shown in FIG. 6, the blank holder 48 is located above the first convex section 52 of the lower die 44 (in the direction of arrow E1).

Then, the blank 12 is placed on the blank holding surface 82 of the blank holder 48. The vicinity of a widthwise outer edge of the blank 12 is held by the blank holding surface 82.

Next, the raising/lowering device (not shown) is driven to lower the upper die 46. As shown in FIG. 6, as the upper die 46 is lowered, the second forming section 66 of the upper die 46 moves toward the blank holder 48. The blank 12 is sandwiched between the upper holding surface 72 of the second forming section 66 and the blank holding surface 82 of the blank holder 48. As a result, the vicinity of the widthwise outer edge of the blank 12 is held by the upper holding surface 72 and the blank holding surface 82.

As the upper die 46 is lowered, the protruding portion 74 presses the blank 12 toward the groove portion 84 of the blank holder 48. The protruding portion 74 is inserted into the groove portion 84 together with the blank 12. As a result, the blank 12 is pressed by the protruding portion 74 and is plastically deformed. The blank 12 is deformed between the protruding portion 74 and the groove portion 84, and the arc-shaped bead 81 protruding downward is thus formed. The bead 81 protrudes in a direction (the direction of arrow E2) orthogonal to the extending direction (the direction of arrow D2) of the flange portion 32 in the workpiece W. The bead 81 extends along the front-rear direction of the workpiece W (directions of arrows A1 and A2) shown in FIG. 1.

As the upper die 46 is further lowered, a portion of the blank 12 that is located further inward in the width direction than the bead 81 is sandwiched between the second curved portion 80 and the blank curved portion 90. A bent formed portion 921 is formed between the second curved portion 80 and the blank curved portion 90. The bent formed portion 921 is curved so as to bulge toward the upper die 46.

When the bent formed portion 921 is plastically deformed, bending stress is generated in the bent formed portion 921. Generally, the bending stress increases as the radius of curvature of a bent portion decreases. That is, the magnitude of the bending stress is inversely proportional to the radius of curvature of the bent portion.

Figure 7:
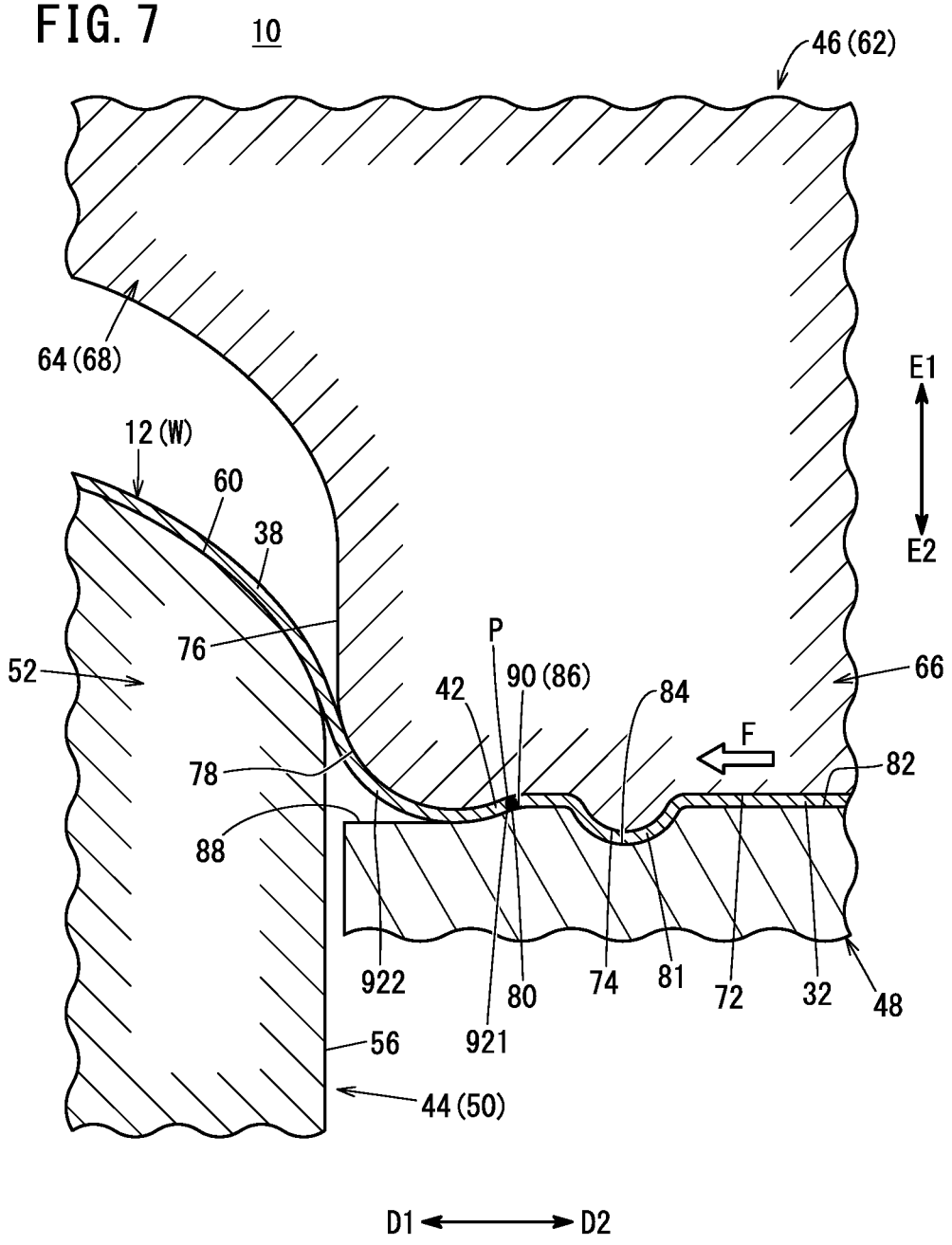
FIG. 7 is a cross-sectional view showing a stage after starting to form the blank by the upper die and a lower die of the forming apparatus of FIG. 6.

Next, as shown in FIG. 7, when the upper die 46 is further lowered, the blank holder 48 is pushed down. The upper die 46 and the blank holder 48 are integrally lowered. The first convex section 52 of the lower die 44 begins to be inserted into the second concave section 68 of the upper die 46. Along with the insertion of the first convex section 52 into the second concave section 68, a portion of the blank 12 that is on the widthwise inner side (in the direction of arrow D1) is inserted into the second concave section 68 of the upper die 46 together with the first convex section 52 of the lower die 44. At this time, the region P that is finally formed into the under portion 28 is positioned further outward in the width direction (the direction of arrow D2) than the protruding portion 74 and the groove portion 84.

The widthwise inner side of the blank 12 is pushed upward (in the direction of arrow E1) by the first convex section 52. The widthwise inner side of the blank 12 enters the inside of the second concave section 68 by the first convex section 52. At this time, a tension F (see FIG. 7) directed inward in the width direction (the direction of arrow D1) is applied to the blank 12. The widthwise outer edge of the blank 12 is pulled inward in the width direction by the first convex section 52. As a result, the widthwise outer end of the blank 12 moves inward in the width direction (in the direction of arrow D1) between the second forming section 66 of the upper die 46 and the blank holder 48.

When the widthwise outer edge of the blank 12 moves inward in the width direction, the amount of movement of the blank 12 is adjusted by the bead 81. The amount of movement of the blank 12 in the width direction can be adjusted by the height of the bead 81, the number of the beads 81, and the arrangement of the beads 81. By adjusting the amount of movement of the blank 12 in the width direction, the amount of entry of the blank 12 into the second concave section 68 is adjusted. As the blank 12 moves, the region P that is finally formed into the under portion 28 moves inward in the width direction (in the direction of arrow D1) beyond the bead 81 via the gap between the protruding portion 74 and the groove portion 84.

Then, as shown in FIG. 7, the region P that is finally formed into the under portion 28 is bent and formed between the second curved portion 80 and the blank curved portion 90. The region P that is finally formed into the under portion 28 becomes the bent formed portion 921. The bent formed portion 921 is curved so as to bulge toward the upper die 46. The bent formed portion 921 has an arc-shaped cross-section along the second curved portion 80 and the blank curved portion 90. The radius of curvature of the bent formed portion 921 corresponds to the radius of curvature S (see FIG. 5) of the second curved portion 80.

As shown in FIG. 7, as the widthwise inner side of the blank 12 enters the inside of the second concave section 68, the blank 12 moves further inward in the width direction. With the movement of the blank 12, the bent formed portion 921, which is the region P that is finally formed into the under portion 28, moves to a position facing the first curved portion 78. When the widthwise inner side of the blank 12 enters the inside of the second concave section 68, the bent formed portion 921 is plastically deformed so as to follow the first curved portion 78 of the upper die 46.

As a result, in the first curved portion 78, an arc-shaped bent formed portion 922 bulging in a direction away from the upper die 46 is formed in the region P. The bent formed portion 922 is curved in a direction opposite to that of the bent formed portion 921 formed by the second curved portion 80. The radius of curvature of the bent formed portion 922 corresponds to the radius of curvature of the first curved portion 78. The radius of curvature of the bent formed portion 922 is greater than the radius of curvature of the bent formed portion 921.

In this way, in the region P that is finally formed into the under portion 28, the bent formed portion 921 is plastically deformed by the first curved portion 78 to form the bent formed portion 922. Bending stress is generated in the bent formed portion 922.

At this time, in the region P of the blank 12 that is finally formed into the under portion 28, the curving direction of the bent formed portion 922 and the curving direction of the bent formed portion 921 are opposite directions. Therefore, the bending stress generated in the bent formed portion 922 and the bending stress generated in the bent formed portion 921 act in opposite directions.

The radius of curvature of the bent formed portion 922 is greater than the radius of curvature of the bent formed portion 921. Therefore, in the region P of the blank 12 that is finally formed into the under portion 28, the bending stress generated when forming the bent formed portion 921 is greater than the bending stress generated when forming the bent formed portion 922. Accordingly, the bending stress generated when forming the bent formed portion 922 is suitably offset by the bending stress generated when forming the bent formed portion 921. As a result, the residual stress in the region P of the blank 12 that is finally formed into the under portion 28 is reduced.

Figure 3:
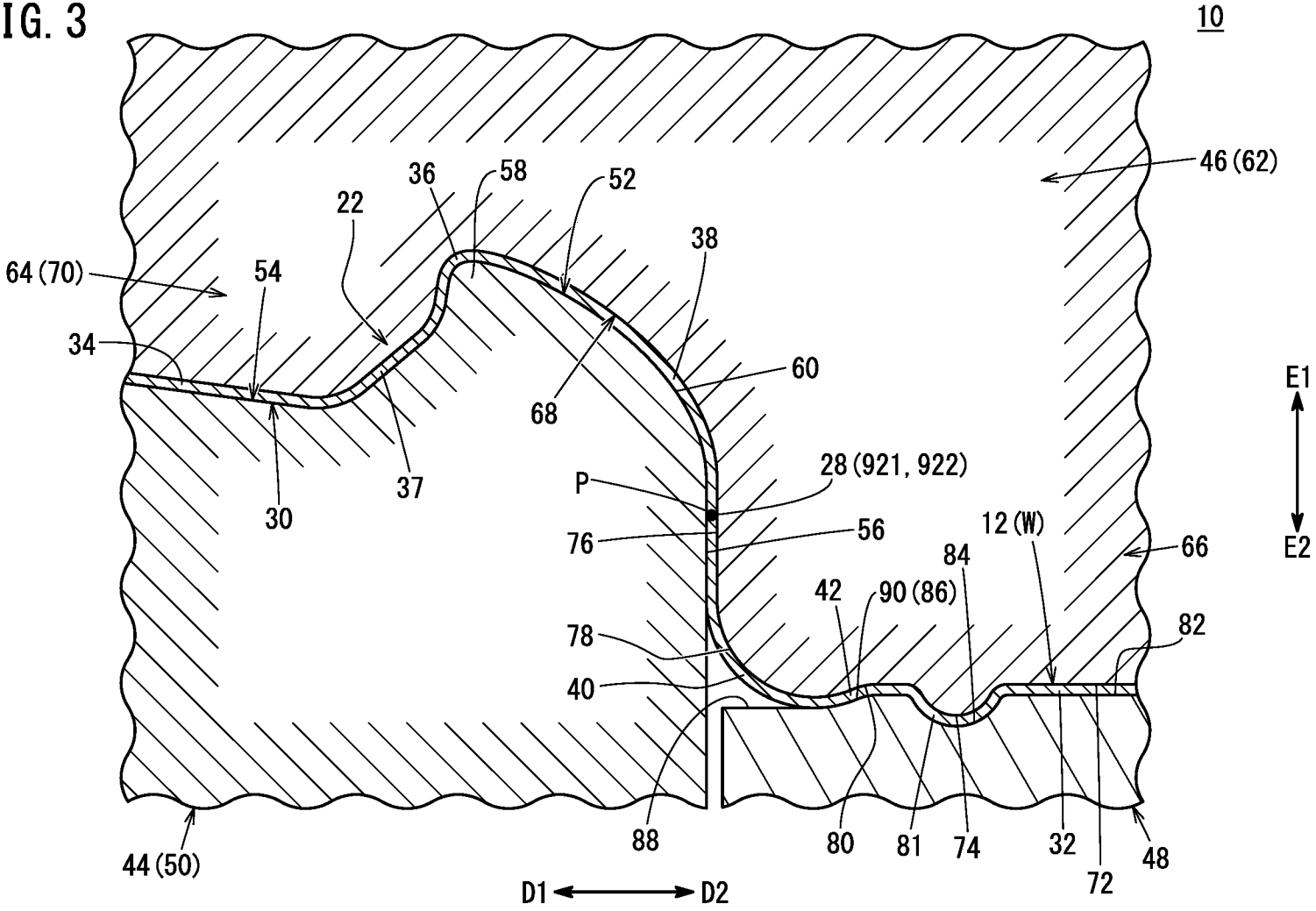
FIG. 3 is a cross-sectional view of a main part showing a part of the forming apparatus.
Figure 4:
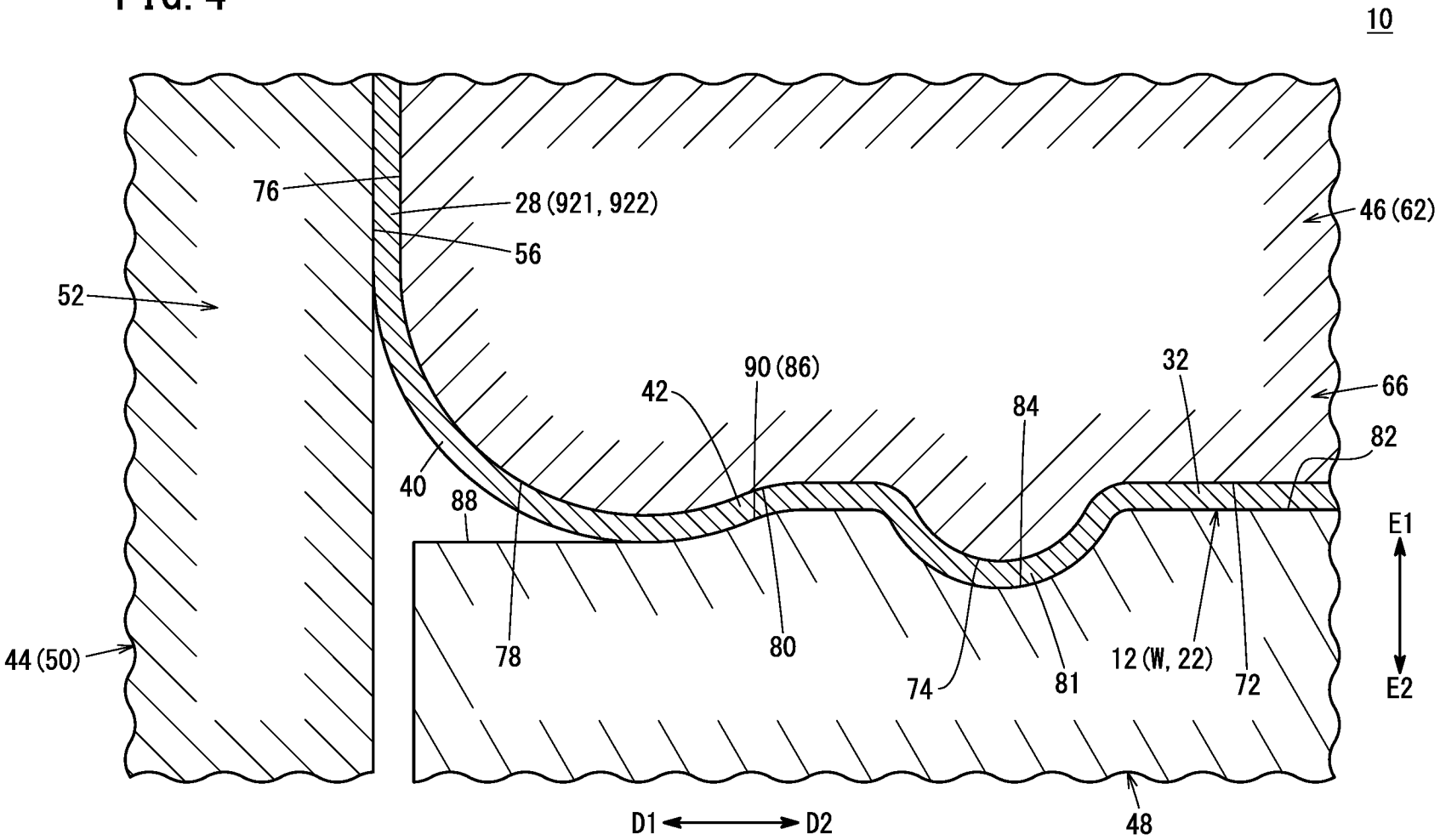
FIG. 4 is an enlarged cross-sectional view of FIG. 3.

Then, as shown in FIGS. 3 and 4, the upper die 46 is further lowered by the driving of the raising/lowering device. As the upper die 46 is lowered, the first convex section 52 of the lower die 44 is inserted into the second concave section 68 together with the blank 12. As a result, the widthwise inner side of the blank 12 further enters the inside of the second concave section 68 by the first convex section 52. The widthwise outer end of the blank 12 further moves inward in the width direction (in the direction of arrow D1) between the second forming section 66 of the upper die 46 and the blank holder 48. At this time, the region P (the bent formed portion 922) of the blank 12 that is finally formed into the under portion 28 moves to between the first vertical surface 56 of the lower die 44 and the second vertical surface 76 of the upper die 46.

When the upper die 46 reaches a position closest to the lower die 44, die closing is performed in the forming apparatus 10. In the die closing of the forming apparatus 10, the blank 12 is sandwiched between the upper die 46 and the lower die 44. The blank 12 is formed between the first forming section 64 of the upper die 46 and the lower forming portion 50 of the lower die 44.

When die closing is performed in the forming apparatus 10, the blank 12 is inserted into the second concave section 68 together with the first convex section 52. The blank 12 is sandwiched between the first vertical surface 56 and the second vertical surface 76. Between the first vertical surface 56 and the second vertical surface 76, the region P that is finally formed into the under portion 28 is sandwiched, and the under portion 28 in the workpiece W is formed. The under portion 28 is flat and extends along the die closing direction of the upper die 46 and the lower die 44 (vertical direction). The under portion 28 has a linear shape along the die closing direction (the directions of arrows E1 and E2) of the forming apparatus 10.

The first bent portion 40 of the workpiece W is formed by the first curved portion 78. The second bent portion 42 of the workpiece W is formed by the second curved portion 80 and the blank curved portion 90. The flat flange portion 32 is formed by the upper holding surface 72 and the blank holding surface 82. The first bent portion 40 connects the under portion 28 and the second bent portion 42. The second bent portion 42 connects the flange portion 32 and the first bent portion 40.

After the bent formed portion 921 is formed in the region P of the blank 12 that is finally formed into the under portion 28 and the bent formed portion 922 is formed in the region P by the first curved portion 78, the region P becomes the under portion 28 which is formed linearly along the die closing direction (the directions of arrows E1 and E2) of the forming apparatus 10. That is, before the under portion 28 is formed into a linear shape, the two bent formed portions 921 and 922 having different curving directions are sequentially formed in the portion corresponding to the under portion 28. Accordingly, the residual stress generated in the under portion 28 is suitably suppressed. As a result, warpage (springback) in the under portion 28 is suppressed.

In other words, in the blank 12, the bent formed portions 921 and 922 having different curving directions are sequentially formed in the region P that is finally formed into the under portion 28. When the blank 12 is formed, bending deformation is applied in a direction opposite to the direction of warpage (springback) caused by residual stress in the under portion 28. Accordingly, when the workpiece W is formed, it is possible to reduce residual stress in the under portion 28 and to suppress occurrence of warpage.

Along with the die closing of the upper die 46 and the lower die 44, the blank 12 is pushed upward and plastically deformed between the first convex section 52 of the lower die 44 and the second concave section 68 of the upper die 46. The projecting part 36 of the side portion 30 in the workpiece W is formed by the protrusion 58 of the first convex section 52 and the second concave section 68. The blank 12 is plastically deformed between the first concave section 54 and the second convex section 70, whereby the base part 34 and the inclined part 37 of the side portion 30 in the workpiece W are formed by the protrusion 58 of the first convex section 52 and the second concave section 68.

Accordingly, in the forming apparatus 10 in which die closing is performed, the blank 12 is formed between the upper forming portion 62 of the upper die 46, the lower forming portion 50 of the lower die 44, and the blank curved surface 86 of the blank holder 48. Thus, the side sill 22 of the workpiece W is obtained from the blank 12. Portions of the workpiece W other than the side sill 22 are formed simultaneously with the side sill 22 by the forming sections of the upper die 46 and the lower die 44.

After the forming of the workpiece W is completed, the raising/lowering device (not shown) is driven to raise the upper die 46. As the upper die 46 is raised, the upper die 46 is separated upward (in the direction of arrow E1) from the lower die 44 and the blank holder 48. By being raised together with the upper die 46, the workpiece W is separated from the lower die 44 and the blank holder 48.

Then, the workpiece W is pressed downward (in the direction of arrow E2) from the upper die 46 by an ejector mechanism (not shown). The workpiece W is released from the upper die 46 and taken out.

In the workpiece W, the bead 81 of the flange portion 32 is necessary when forming the workpiece W, but after the work W is formed, the bead 81 becomes unnecessary. Therefore, after the above-described drawing (drawing step) of the workpiece W, the vicinity of the end portion of the flange portion 32 including the bead 81 is cut off in a trimming step. As a result, the bead 81 is removed from the flange portion 32 of the workpiece W, and the flange portion 32 has a shape extending downward from the under portion 28 and having a predetermined length.

After the trimming step of the flange portion 32 is completed, a side outer panel, which is a product, is obtained through a bending step for providing a product shape (final shape). In FIG. 2, the shape of a product obtained by forming from the first bent portion 40 to the flange portion 32 of the workpiece W is indicated by two dot chain lines. In the product shape obtained through the bending step, as shown in FIG. 2, the first bent portion 40 is bent at a substantially right angle, and the flange portion 32 is bent at the second bent portion 42 to form a final flange portion 94. The final flange portion 94 flatly extends inward from a product bent portion 96 obtained by bending the second bent portion 42. The final flange portion 94 is bent further inward than the flange portion 32. The product bent portion 96 is obtained by bending the second bent portion 42 at a substantially right angle.

As described above, according to the embodiment of the present invention, in the forming apparatus 10, the blank 12 is drawn to obtain the workpiece W having the under portion 28 that extends along the die opening direction. The forming apparatus 10 includes the lower die 44, the upper die 46, and the blank holder 48. The lower die 44 includes the first convex section 52. The upper die 46 faces the lower die 44 and is movable relative thereto. The upper die 46 includes the second concave section 68, and the upper holding surface 72 adjacent to the second concave section 68. The first convex section 52 of the lower die 44 can be inserted into the second concave section 68. The blank holder 48 faces the upper holding surface 72 of the upper die 46. The blank holder 48 includes the blank holding surface 82 that faces the upper holding surface 72 and holds the blank 12. The blank holder 48 presses the blank 12 against the upper holding surface 72 to hold the blank 12.

The upper die 46 includes the first curved portion 78 and the second curved portion 80 between the second concave section 68 and the upper holding surface 72. The first curved portion 78 has an arc-shaped cross section and is curved so as to bulge in a direction away from the upper die 46. The second curved portion 80 has an arc-shaped cross section and is curved so as to bulge in a direction opposite to the bulging direction of the first curved portion 78. The blank holding surface 82 faces the second curved portion 80. The blank holding surface 82 includes the blank curved surface 86 recessed along the second curved portion 80.

In the upper die 46, the curving direction of the second curved portion 80 is opposite to the curving direction of the first curved portion 78. Accordingly, when the workpiece W including the under portion 28 is formed, the direction of the bending stress generated when the blank 12 is formed by the second curved portion 80 is opposite to the direction of the bending stress generated when the blank 12 is formed by the first curved portion 78.

As a result, in the forming apparatus 10, with a simple configuration in which the upper die 46 is provided with the second curved portion 80 whose curving direction is opposite to that of the first curved portion 78, it is possible to reduce residual stress generated in the under portion 28 adjacent to the first bent portion 40, and to suppress warpage (springback) of the under portion 28 due to the residual stress.

In the upper die 46, the radius of curvature S of the second curved portion 80 is smaller than the radius of curvature R of the first curved portion 78 (S<R). The bending stress has a characteristic that it increases as the radius of the bent portion decreases. Therefore, the bending stress generated when the bent formed portion 921 is formed by the second curved portion 80 can be made greater than the bending stress generated when the bent formed portion 922 is formed by the first curved portion 78. As a result, even in the vicinity of the first bent portion 40 formed by the first curved portion 78, the residual stress generated in the under portion 28 can be suitably reduced. Therefore, the occurrence of warpage (springback) in the under portion 28 of the workpiece W can be effectively suppressed. Further, the radius of curvature S of the second curved portion 80 is small, whereby it is possible to reduce the size of the structure of the upper forming portion 62 in the upper die 46. As a result, it is possible to minimize a change in the shape of the upper die 46 and suppress an increase in manufacturing cost.

The upper holding surface 72 of the upper die 46 includes the protruding portion 74 protruding toward the blank holder 48. The blank holding surface 82 of the blank holder 48 includes the groove portion 84 recessed in a direction away from the upper die 46. The groove portion 84 faces the protruding portion 74. The second curved portion 80 of the upper die 46 is disposed closer to the lower die 44 than the protruding portion 74 is. The blank curved surface 86 of the blank holder 48 is disposed closer to the lower die 44 than the groove portion 84 is.

Accordingly, when the blank 12 is formed, the bead 81 is formed between the protruding portion 74 and the groove portion 84. When the blank 12 is pushed into the second concave section 68 of the upper die 46, the tension F applied to the blank 12 inward in the width direction can be adjusted by the bead 81. By bringing the second curved portion 80 closer to the lower die 44 than the bead 81 is, bending stress can be applied to the under portion 28 of the workpiece W in a direction opposite to that of the bending stress generated when the first bent portion 40 is formed. As a result, it is possible to reduce the residual stress of the under portion 28 of the workpiece W and to suppress warpage (springback) caused by the residual stress.

The second curved portion 80 is disposed at a position corresponding to the product bent portion 96 of the side outer panel, which is the final form (product form) of the workpiece W, to form the blank 12. That is, in the workpiece W, the position of the second bent portion 42 in the flange portion 32 is made to coincide with the position of the product bent portion 96 of the side outer panel which is the final form. As a result, in the final form after the bending process, unevenness is not generated on the final flange portion 94 (flat portion) of the side outer panel adjacent to the product bent portion 96.

The blank 12 is a high-tensile steel plate. The high-tensile steel plate has a characteristic that the ductility decreases as the strength increases. The upper die 46 is provided with the first and second curved portions 78 and 80. The first bent portion 40 is formed by the first curved portion 78, and the second bent portion 42 is formed by the second curved portion 80. When the blank 12 is formed to obtain the work W, the curving direction of the first bent portion 40 and the curving direction of the second bent portion 42 are opposite directions in the region P that is finally formed into the under portion 28. As a result, when the blank 12 is drawn, residual stress in the region P can be reduced, and warpage (spring-back) generated in the under portion 28 can be suitably suppressed.

The above-described embodiment can be summarized as follows.

According to the above embodiment, provided is a forming apparatus (10) that obtains a workpiece (W) including a vertical portion (28) extending along a die closing direction by drawing a blank (12), the forming apparatus (10) comprising: a lower die (44) including a convex-shaped forming portion (52) that includes a first vertical surface (56); an upper die (46) that faces the lower die and is movable relative thereto, the upper die including a concave-shaped forming portion (68) into which the convex-shaped forming portion is inserted, and an upper holding portion (72) adjacent to the concave-shaped forming portion, wherein the concave-shaped forming portion includes a second vertical surface (76), and the vertical portion is formed between the first vertical surface and the second vertical surface; and a blank holder (48) that faces the upper holding portion of the upper die, and is configured to press the blank toward the upper holding portion, wherein the upper die includes, between the concave-shaped forming portion and the upper holding portion: a first curved portion (78) that is curved so as to bulge in a direction away from the upper die, and is configured to form a first bent portion (40) in the blank; and a second curved portion (80) that is curved in a direction opposite to a bulging direction of the first curved portion, and is configured to form a second bent portion (42) in the blank, the first curved portion is disposed between the concave-shaped forming portion and the second curved portion, and the blank holder includes a blank holding portion (82) that faces the upper holding portion and is configured to hold the blank, the blank holding portion including a blank curved portion (86) facing the second curved portion and curved along the second curved portion.

A radius of curvature (S) of the second curved portion is smaller than a radius of curvature (R) of the first curved portion.

The upper holding portion includes a protruding portion (74) protruding toward the blank holder, the blank holding portion includes a groove portion (84) facing the protruding portion and recessed in the direction away from the upper die, and the second curved portion and the blank curved portion are disposed closer to the lower die than the protruding portion and the groove portion are.

The second curved portion is disposed at a position corresponding to a product bent portion (921) in a final form of the workpiece, and is configured to form the blank.

The blank is a high-tensile steel plate.

A forming method for obtaining a workpiece including a vertical portion extending along a die closing direction by drawing a blank using a forming apparatus, wherein the forming apparatus includes: a lower die including a convex-shaped forming portion that includes a first vertical surface; an upper die that faces the lower die and is movable relative thereto, the upper die including a concave-shaped forming portion into which the convex-shaped forming portion is inserted, and an upper holding portion adjacent to the concave-shaped forming portion, wherein the concave-shaped forming portion includes a second vertical surface, and the vertical portion is formed between the first vertical surface and the second vertical surface; and a blank holder that faces the upper holding portion of the upper die and is configured to press the blank toward the upper holding portion, the upper die includes, between the concave-shaped forming portion and the upper holding portion: a first curved portion that is curved so as to bulge in a direction away from the upper die and is configured to form a first bent portion in the blank; and a second curved portion that is curved in a direction opposite to a bulging direction of the first curved portion and is configured to form a second bent portion in the blank, the first curved portion is disposed between the concave-shaped forming portion and the second curved portion, and the blank holder includes a blank holding portion that faces the upper holding portion and is configured to hold the blank, the blank holding portion including a blank curved portion facing the second curved portion and curved along the second curved portion, the forming method comprising: holding the blank between the upper holding portion and the blank holding portion; and drawing the blank by moving the upper die and the lower die relative to each other, wherein in the drawing of the blank, when a region of the blank that is finally formed into the vertical portion is defined as a vertical portion-intended region (P), the vertical portion-intended region moves from between the upper holding portion and the blank holding portion to between the first vertical surface and the second vertical surface, and the drawing of the blank includes: bending the vertical portion-intended region by the second curved portion; bending, by the first curved portion, the vertical portion-intended region that has been formed by the second curved portion; and forming the vertical portion-intended region that has been moved to between the first vertical surface of the lower die and the second vertical surface of the upper die, into a flat shape by the first vertical surface and the second vertical surface.

The present invention is not limited to the above-described embodiment, and various configurations can be adopted therein without departing from the essence and gist of the present invention.

What is claimed is:

1. A forming apparatus that obtains a workpiece including a vertical portion extending along a die closing direction by drawing a blank, the forming apparatus comprising:

a lower die including a convex-shaped forming portion that includes a first vertical surface;

an upper die that faces the lower die and is movable relative thereto, the upper die including a concave-shaped forming portion into which the convex-shaped forming portion is inserted, and an upper holding portion adjacent to the concave-shaped forming portion, wherein the concave-shaped forming portion includes a second vertical surface, and the vertical portion is formed between the first vertical surface and the second vertical surface; and a blank holder that faces the upper holding portion of the upper die, and is configured to press the blank toward the upper holding portion, wherein the upper die further includes, between the concave-shaped forming portion and the upper holding portion:

a first curved portion that is curved so as to bulge in a direction away from the upper die, and is configured to form a first bent portion in the blank; and a second curved portion including a convex arc that is curved in a direction opposite to a bulging direction of the first curved portion, and is configured to form a second bent portion in the blank, the first curved portion is disposed between the concave-shaped forming portion and the second curved portion, the blank holder includes a blank holding portion that faces the upper holding portion and is configured to hold the blank, the blank holding portion including a blank curved portion facing the second curved portion and curved along the second curved portion, and the second curved portion and at least a part of the upper holding portion are arranged at upward positions relative to a lowermost point of the first curved portion bulging to the blank holder, and the second curved portion connects the first curved portion to the upper holding portion.

2. The forming apparatus according to claim 1, wherein a radius of curvature of the second curved portion is smaller than a radius of curvature of the first curved portion.

3. The forming apparatus according to claim 1, wherein the upper holding portion includes a protruding portion protruding toward the blank holder, the blank holding portion includes a groove portion facing the protruding portion and recessed in the direction away from the upper die, and the second curved portion and the blank curved portion are disposed closer to the lower die than the protruding portion and the groove portion are.

4. The forming apparatus according to claim 1, wherein the second curved portion is disposed at a position corresponding to a product bent portion in a final form of the workpiece, and is configured to form the blank.

5. The forming apparatus according to claim 1, wherein the blank is a high-tensile steel plate.

6. A forming method for obtaining a workpiece including a vertical portion extending along a die closing direction by drawing a blank using a forming apparatus, wherein the forming apparatus includes:

a lower die including a convex-shaped forming portion that includes a first vertical surface;

an upper die that faces the lower die and is movable relative thereto, the upper die including a concave-shaped forming portion into which the convex-shaped forming portion is inserted, and an upper holding portion adjacent to the concave-shaped forming portion, wherein the concave-shaped forming portion includes a second vertical surface, and the vertical portion is formed between the first vertical surface and the second vertical surface; and a blank holder that faces the upper holding portion of the upper die, and is configured to press the blank toward the upper holding portion, the upper die further includes, between the concave-shaped forming portion and the upper holding portion:

a first curved portion that is curved so as to bulge in a direction away from the upper die and is configured to form a first bent portion in the blank; and a second curved portion including a convex arc that is curved in a direction opposite to a bulging direction of the first curved portion and is configured to form a second bent portion in the blank, the first curved portion is disposed between the concave-shaped forming portion and the second curved portion, the blank holder includes a blank holding portion that faces the upper holding portion and is configured to hold the blank, the blank holding portion including a blank curved portion facing the second curved portion and curved along the second curved portion, and the second curved portion and at least a part of the upper holding portion are arranged at upward positions relative to a lowermost point of the first curved portion bulging to the blank holder, and the second curved portion connects the first curved portion to the upper holding portion, the forming method comprising:

holding the blank between the upper holding portion and the blank holding portion; and drawing the blank by moving the upper die and the lower die relative to each other, wherein in the drawing of the blank, when a region of the blank that is finally formed into the vertical portion is defined as a vertical portion-intended region, the vertical portion-intended region moves from between the upper holding portion and the blank holding portion to between the first vertical surface and the second vertical surface, and the drawing of the blank includes:

bending the vertical portion-intended region by the second curved portion;

bending, by the first curved portion, the vertical portion-intended region that has been formed by the second curved portion; and forming the vertical portion-intended region that has been moved to between the first vertical surface of the lower die and the second vertical surface of the upper die, into a flat shape by the first vertical surface and the second vertical surface.

* * * * *